US009349229B2

(12) United States Patent
Hashimoto et al.

(10) Patent No.: US 9,349,229 B2
(45) Date of Patent: May 24, 2016

(54) DATA RECORDING APPARATUS FOR A VEHICLE

(75) Inventors: Yoshiyuki Hashimoto, Miyoshi (JP); Masaaki Uechi, Nagoya (JP); Tetsuya Ishitani, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/350,682

(22) PCT Filed: Oct. 21, 2011

(86) PCT No.: PCT/JP2011/074363
§ 371 (c)(1),
(2), (4) Date: Apr. 9, 2014

(87) PCT Pub. No.: WO2013/057842
PCT Pub. Date: Apr. 25, 2013

(65) Prior Publication Data

US 2014/0257594 A1 Sep. 11, 2014

(51) Int. Cl.
*G07C 5/10* (2006.01)
*G07C 5/08* (2006.01)

(52) U.S. Cl.
CPC . *G07C 5/10* (2013.01); *G07C 5/085* (2013.01)

(58) Field of Classification Search
CPC ..... G07C 5/10; G07C 5/085
USPC ..... 701/1
See application file for complete search history.

(56) References Cited

U.S. PATENT DOCUMENTS

2002/0035422 A1 3/2002 Sasaki
2003/0033062 A1* 2/2003 Nishina ..... 701/35
2007/0050109 A1* 3/2007 Ozawa ..... 701/35

(Continued)

FOREIGN PATENT DOCUMENTS

JP 2002-042288 A 2/2002
JP 2003-063327 A 3/2003

(Continued)

OTHER PUBLICATIONS

International Search Report issued Jan. 31, 2012 in PCT/JP11/074363 filed Oct. 21, 2011.

(Continued)

*Primary Examiner* — Mussa A Shaawat
*Assistant Examiner* — Yazan A Soofi
(74) *Attorney, Agent, or Firm* — Oblon, McClelland, Maier & Neustadt, L.L.P

(57) ABSTRACT

In order to carry out data recording efficiently, a data recording apparatus for a vehicle in the present invention determines whether a predetermined event occurs in a vehicle. When it is determined that a predetermined event occurs, generally at least data indicating a vehicle state is recorded in a recording part from an occurrence of the predetermined event until a predetermined period of time elapses. Also, it is determined whether, at a time when it is determined that the predetermined event occurs, the recording in the recording part is actually being carried out. When it is determined that the recording is actually being carried out, the data indicating the vehicle state at that time is recorded in the recording part instead of recording the data based on the occurrence of the predetermined event at least from the occurrence of the predetermined event until the predetermined period of time elapses.

6 Claims, 10 Drawing Sheets

(56) References Cited

U.S. PATENT DOCUMENTS

| | | | | |
|---|---|---|---|---|
| 2007/0150138 | A1* | 6/2007 | Plante | 701/35 |
| 2008/0234890 | A1* | 9/2008 | Okada et al. | 701/35 |
| 2009/0058995 | A1 | 3/2009 | Yamashita | |
| 2012/0041637 | A1* | 2/2012 | Allemang | 701/31.5 |

FOREIGN PATENT DOCUMENTS

| | | | |
|---|---|---|---|
| JP | 2003-312553 | | 11/2003 |
| JP | 2007-038985 | A | 2/2007 |
| JP | 2007-055369 | | 3/2007 |
| JP | 2008-186174 | A | 8/2008 |
| JP | 2009-076050 | A | 4/2009 |
| JP | 2010-009249 | A | 1/2010 |
| WO | 2009/125454 | A1 | 10/2009 |

OTHER PUBLICATIONS

Extended European Search Report issued May 20, 2015 in Patent Application No. 11874232.9.

* cited by examiner

DATA RECORDING APPARATUS FOR A VEHICLE

TECHNICAL FIELD

The present invention relates to a data recording apparatus for a vehicle, and, in particular, to a data recording apparatus for a vehicle that is mounted in a vehicle and is suitable for recording, by a recording means, data that indicates a vehicle state in a case where a predetermined event occurs in the vehicle.

BACKGROUND ART

In the related art, a data recording apparatus for a vehicle is known (for example, see Patent Document 1) that records data in a nonvolatile memory showing a vehicle state in a case where a predetermined event occurs in the vehicle. In the data recording apparatus for a vehicle, data indicating the vehicle state is sampled every predetermined sampling time. Then, when it is determined that a predetermined event occurs in the vehicle, data for a predetermined period of time before the occurrence of the event and data for a predetermined period of time after the occurrence of the event are transferred to and are recorded in the nonvolatile memory. Note that the above-mentioned sampling time is determined as being different depending on the vehicle state. Therefore, in the data recording apparatus for a vehicle, it is possible to record data of the vehicle state before and after the occurrence of the event in the nonvolatile memory while saving the data recording capacity of the nonvolatile memory.

Further, in the data recording apparatus for a vehicle, the counter value when the event occurs is recorded in the nonvolatile memory for the purpose of determining when the event occurs. Note that a timer for data sampling is used in common for determining whether an event occurs. Therefore, timing of data sampling and timing of determining whether an event occurs are coincident with one another.

PRIOR ART DOCUMENT

Patent Document

Patent Document 1: Japanese Laid-Open Patent Application No. 2007-55369

SUMMARY OF THE INVENTION

Problem to be Solved by the Invention

However, in the data recording apparatus for a vehicle described in the above-mentioned Patent Document 1, vehicle data is recorded in a duplicate manner at the same time since data recording is carried out separately based on respective event occurrences in a case where an event occurs plural times successively in the vehicle. Therefore, the nonvolatile memory for data recording is consumed uselessly.

Further, in the data recording apparatus for a vehicle described in the above-mentioned Patent Document 1, the resolution of the event occurrence time depends on the time interval of data sampling and therefore the precision of the timer for data sampling. At this point, it is necessary to shorten the time interval in order to increase the resolution of event occurrence time to be determined. However, in this configuration, a processing load of a calculation part increases and the cost increases.

The present invention has been devised in consideration of the above-described points, and an objective is to provide a data recording apparatus for a vehicle by which it is possible to carry out data recording efficiently and easily increase the resolution of event occurrence time to be determined.

Means for Solving the Problem

The above-mentioned objective is achieved by a data recording apparatus for a vehicle including an event occurrence determination means that determines whether a predetermined event occurs in a vehicle; a first data recording control means that, in a case where the event occurrence determination means determines that the predetermined event occurs, records data indicating a vehicle state in a recording means at least until a predetermined period of time elapses from the occurrence of the predetermined event; an on-data-recording determination means determines whether the recording is actually being carried out by the first data recording control means at a time when it is determined by the event occurrence determination means that the predetermined event occurs; a second data recording control means that, in a case where the on-data-recording determination means determines that the recording is actually being carried out by the first recording control means at the time, carries out recording of the data at the time in the recording means instead of the recording by the first data recording control means based on the occurrence of the predetermined event.

Further, the above-mentioned objective is achieved by a data recording apparatus for a vehicle including an event occurrence determination means that determines whether a predetermined event occurs in a vehicle; an on-data-recording determination means determines whether recording is actually being carried out at a time when it is determined by the event occurrence determination means that the predetermined event occurs; and a data recording control means that, depending on a determination result of the on-data-recording determination means, switches recording of the data in the recording means between at least until a predetermined period of time elapses from an occurrence of the predetermined event and only at the time.

Further, the above-mentioned objective is achieved by a data recording apparatus for a vehicle including an event occurrence determination means that determines whether a predetermined event occurs in a vehicle; a data recording control means that, in a case where the event occurrence determination means determines that the predetermined event occurs, records data indicating a vehicle state in a recording means at least until a predetermined period of time elapses from the occurrence of the predetermined event; an on-data-recording determination means determines whether the recording is actually being carried out by the data recording control means at a time when it is determined by the event occurrence determination means that the predetermined event occurs; a recording extension means that, in a case where the on-data-recording determination means determines that the recording is actually being carried out by the recording control means at the time, defers a time of finishing the recording of the data that is actually being carried out by the data recording control means instead of the recording by the data recording control means based on the occurrence of the predetermined event.

Further, the above-mentioned objective is achieved by a data recording apparatus for a vehicle including an event occurrence determination means that determines whether a predetermined event occurs in a vehicle; an on-data-recording determination means determines whether recording is actually being carried out at a time when it is determined by the event occurrence determination means that the predetermined event occurs; and a data recording control part that, depending on a determination result of the on-data-recording determination means, switches recording of the data in the recording means between at least until a predetermined period of time elapses from an occurrence of the predetermined event and in a manner of extending the recording so as to defer a finish time of the recording that is actually being carried out.

Further, the above-mentioned objective is achieved by a data recording apparatus for a vehicle including an event occurrence determination means that determines whether a predetermined event occurs in a vehicle; a first data recording control means that, in a case where the event occurrence determination means determines that the predetermined event occurs, records data indicating a vehicle state at each predetermined time in a recording means at least until a predetermined period of time elapses from an occurrence of the predetermined event; an occurrence time recording control means that records in the recording means a time when the predetermined event occurs calculated by using a second timer different from a first timer that counts a time required for generating timing for the recording by the first data recording control means; an on-data-recording determination means determines whether the recording is actually being carried out by the first data recording control means at a time when it is determined by the event occurrence determination means that the predetermined event occurs; a timer control means that, in a case where the on-data-recording determination means determines that the recording by the first data recording control means is not being carried out at the time, resets and starts the second timer.

In this case, the second timer may count an elapsed time from a time when the predetermined event occurs when the recording by the first data recording control means is not being carried out, and the occurrence time recording control means may record, in the recording means, as a time when the predetermined event occurs, the elapsed time given by the second timer at a time of the recording by the first data recording control means arriving firstly after the occurrence of the predetermined event that occurs when the recording by the first data recording control means is not being carried out or a time of a subsequent occurrence of the predetermined event.

Further a second data recording control means may be provided which, in a case where the on-data-recording determination means determines that the recording by the first data recording control means is actually being carried out at the time, carries out the recording of the data at the time in the recording means instead of the recording of the data by the first data recording control means based on the occurrence of the predetermined event, and, in the case where the on-data-recording determination means determines that the recording by the first data recording control means is not actually being carried out at the time, the data recorded by the second data recording control means and the time recorded by the occurrence time recording control means may be recorded in a manner of being linked with one another.

Further, the above-mentioned objective is achieved by a data recording apparatus for a vehicle including an event occurrence determination means that determines whether a predetermined event occurs in a vehicle; and a data recording control means that, in a case where the event occurrence determination means determines that the predetermined event occurs, records data indicating a vehicle state at each predetermined time in a recording means at least until a predetermined period of time elapses from an occurrence of the predetermined event. In the data recording control means, the closer to the time of occurrence of the event a current time is, the shorter an interval of the predetermined time is, and the farther from the time of occurrence of the event a current time is, the longer an interval of the predetermined time is.

Further, the above-mentioned objective is achieved by a data recording apparatus for a vehicle including an event occurrence determination means that determines whether a predetermined event occurs in a vehicle; and a data recording control means that, in a case where the event occurrence determination means determines that the predetermined event occurs, records data indicating a vehicle state at each predetermined time in a recording means at least from a predetermined period of time before the occurrence of the predetermined event to the occurrence of the predetermined event. In the data recording control means, the farther from the time of occurrence of the event a current time is, the longer an interval of the predetermined time is; and the closer to the time of occurrence of the event a current time is, the shorter an interval of the predetermined time is.

Advantageous Effect of the Invention

By the present invention, it is possible to carry out data recording efficiently. Further, it is possible to easily increase the resolution of an event occurrence time to be determined.

MODE FOR CARRYING OUT THE INVENTION

Below, using the drawings, the specific embodiments of data recording apparatuses for vehicle according to the present invention will be described.

Embodiment 1

Figure 1:
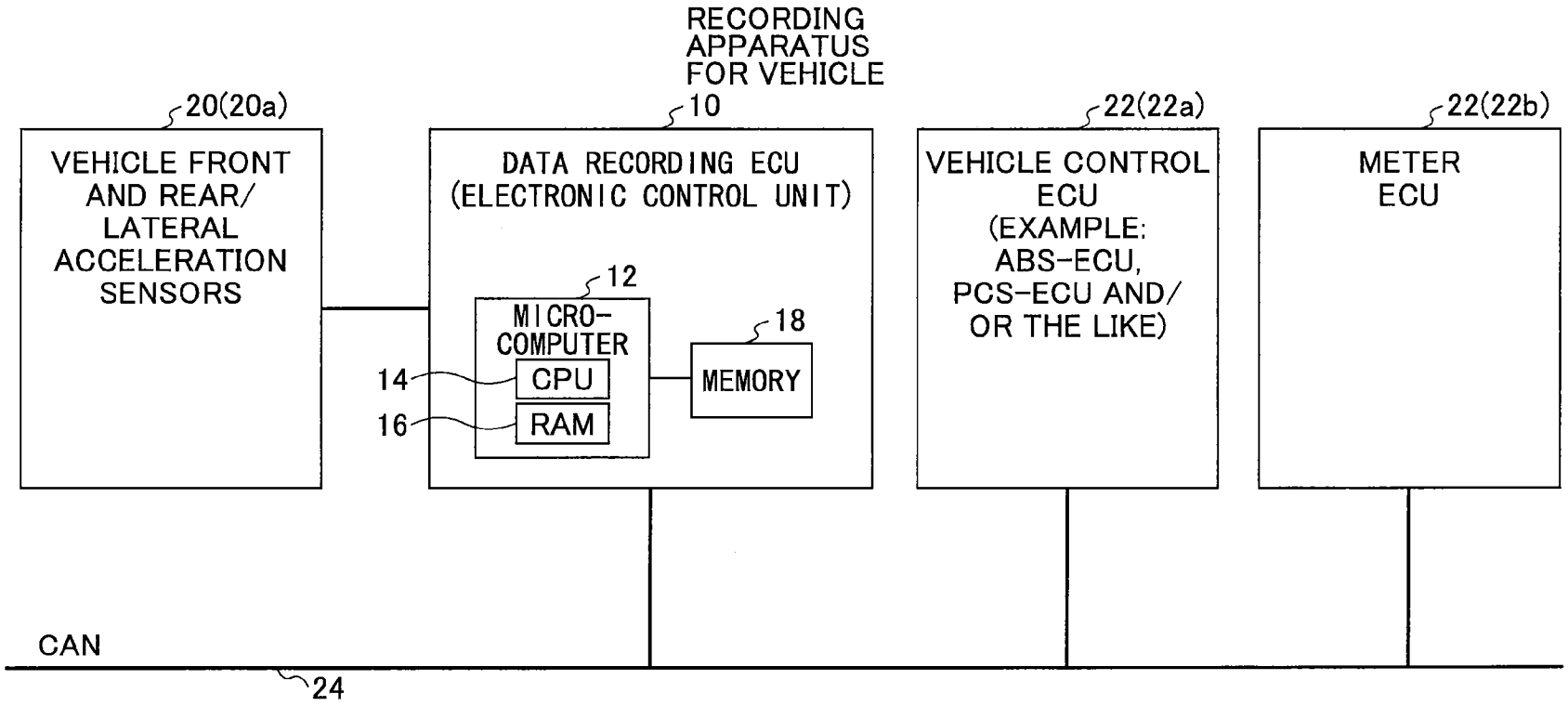
FIG. 1 is a configuration diagram of an on-vehicle system including a data recording apparatus for a vehicle according to a first embodiment of the present invention.

FIG. 1 shows a configuration diagram of an on-vehicle system including a data recording apparatus for a vehicle 10 according to the first embodiment of the present invention. The data recording apparatus for a vehicle 10 in the present embodiment is mounted in a vehicle, records data indicating vehicle states such as usage states and/or traveling states of the vehicle during traveling or the like, and, after traveling or the like, outputs the recorded data to the outside for the purpose of analyzing the usage states during traveling and/or the traveling states of the vehicle.

As shown in FIG. 1, the on-vehicle system according to the present embodiment includes the data recording apparatus for a vehicle 10. The data recording apparatus for a vehicle 10 is a data recording ECU which mainly includes a microcomputer 12. The microcomputer 12 has a central processing unit (CPU) 14 and a RAM 16. The CPU 14 carries out various sorts of operations for data recording. The RAM 16 is a re-writable volatile memory that is a temporary recording area and capable of recording only when an ignition switch of the vehicle is on.

The data recording apparatus for a vehicle 10 includes a memory 18 connected to the microcomputer 12. The memory 18 is a re-writeable nonvolatile memory that is a permanent recording area and recording can be carried out regardless of whether the ignition switch of the vehicle is on or off. Note that the memory 18 may be an EEPROM externally attached to the microcomputer 12 or may be a flash ROM incorporated in the microcomputer 12.

To the data recording apparatus for a vehicle 10, various sorts of sensors 20 and Electronic Control Units (ECUs) 22 are connected directly or via an onboard communication network 24 such as CAN. The sensors 20 output electric signals in accordance with respective parameters such as the vehicle speed, the front and rear acceleration, the lateral acceleration, the vehicle yaw rate, the opening degree of the accelerator, the braking, the brake master cylinder oil pressure, the brake wheel cylinder oil pressure, the position in the shift lever, the steering angle, the steering torque, the tire air pressures and/or the like, indicating the usage states or the traveling states of the vehicle. The ECUs 22 mainly include microcomputers and are control circuits that output signals in accordance with the above-mentioned parameters indicating the use sate or the traveling states of the vehicle and the operation states in vehicle control apparatuses (for example, an antilock brake system, a collision prevention alarm apparatus and/or the like).

Note that, as to the sensors 20 and the ECUs 22, at least one thereof is to be provided which outputs a signal indicating a specific one of the usage states or the traveling states. Further, it is also possible that two or more of the sensors 20 and the ECUs 22 are provided which output signals indicating the usage state(s) and/or the traveling state(s) of the vehicle that are different from each other. For example, the sensors 20 may include a front and rear acceleration sensor that outputs an electric signal(s) corresponding to front and rear acceleration. The ECUs 22 may include, for example, an engine ECU that carries out engine control, a brake control ECU that carries out brake control, a steering ECU that carries out steering control, a meter ECU that carries out control of displaying meters of the vehicle and or the like.

Note that FIG. 1 shows, as an example of the sensors 20, a vehicle front and rear/lateral acceleration sensor(s) 20*a* that outputs an electric signal(s) corresponding to the front and rear acceleration and the lateral acceleration. As examples of the ECU 22, a vehicle control ECU 22*a* that carries out traveling control of the vehicle (for example, an ABS-ECU carrying out antilock brake control, a PCS-ECU carrying out pre-crash control and/or the like) and a meter ECU 22*b* that carries out control of displaying meters of the vehicle are shown.

Further, in the present embodiment, to the data recording apparatus for a vehicle 10, as shown in FIG. 1, the sensors 20 are directly connected, and also, the ECUs 22 are connected via the onboard communication network 24. Thus, the output signals of the sensors 20 are directly supplied to the data recording apparatus for a vehicle 10, and the output signals of the ECUs 22 are supplied to the data recording apparatus for a vehicle 10 and/or other ECU(s) via the onboard communication network 24. The data recording apparatus for a vehicle 10 and the ECUs 22 can carry out mutual communication using a protocol(s) suitable to the onboard communication network 24.

Figure 2:
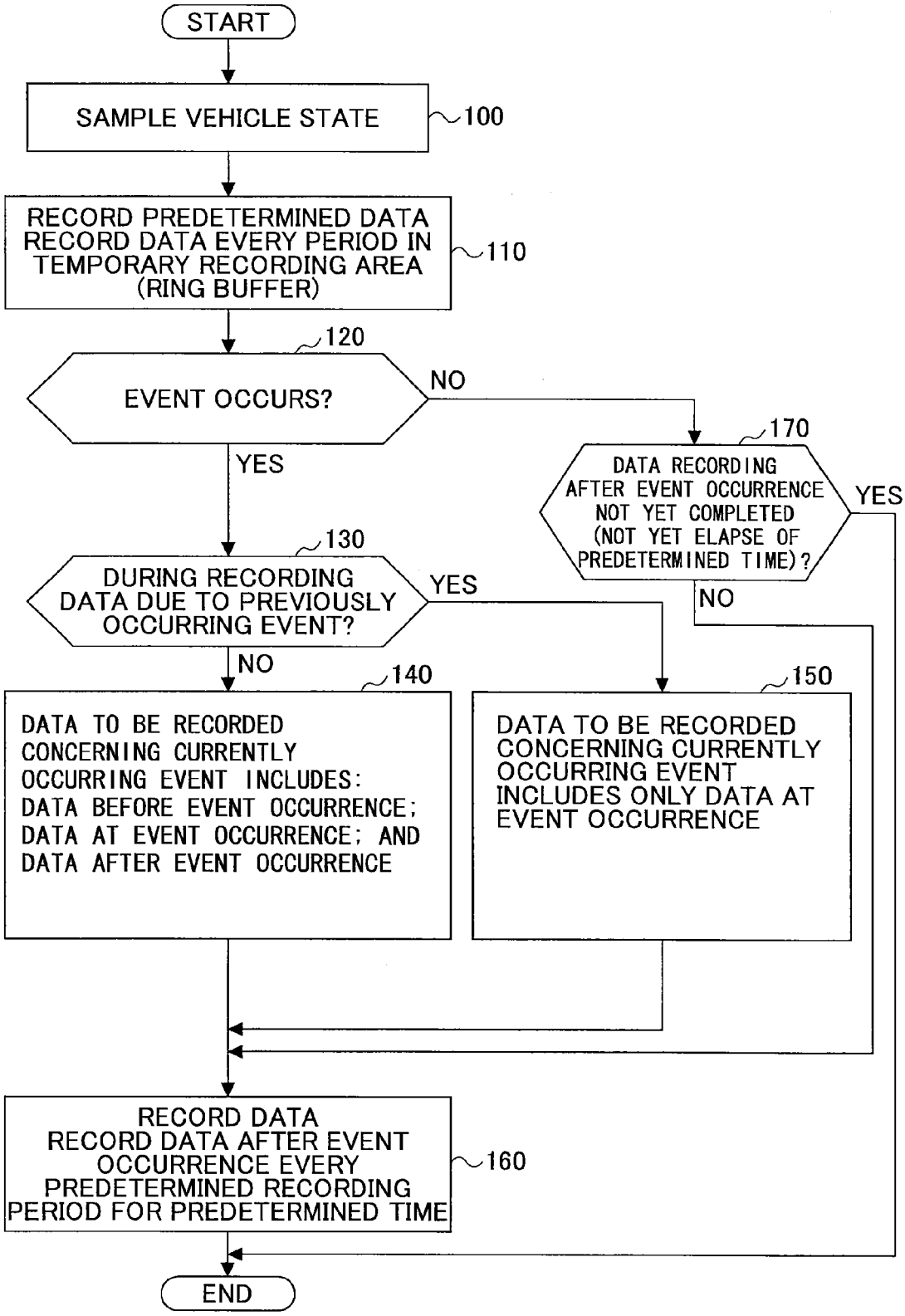
FIG. 2 is a flowchart of a control routine executed in the data recording apparatus for a vehicle according to the first embodiment of the present invention.
Figure 3:
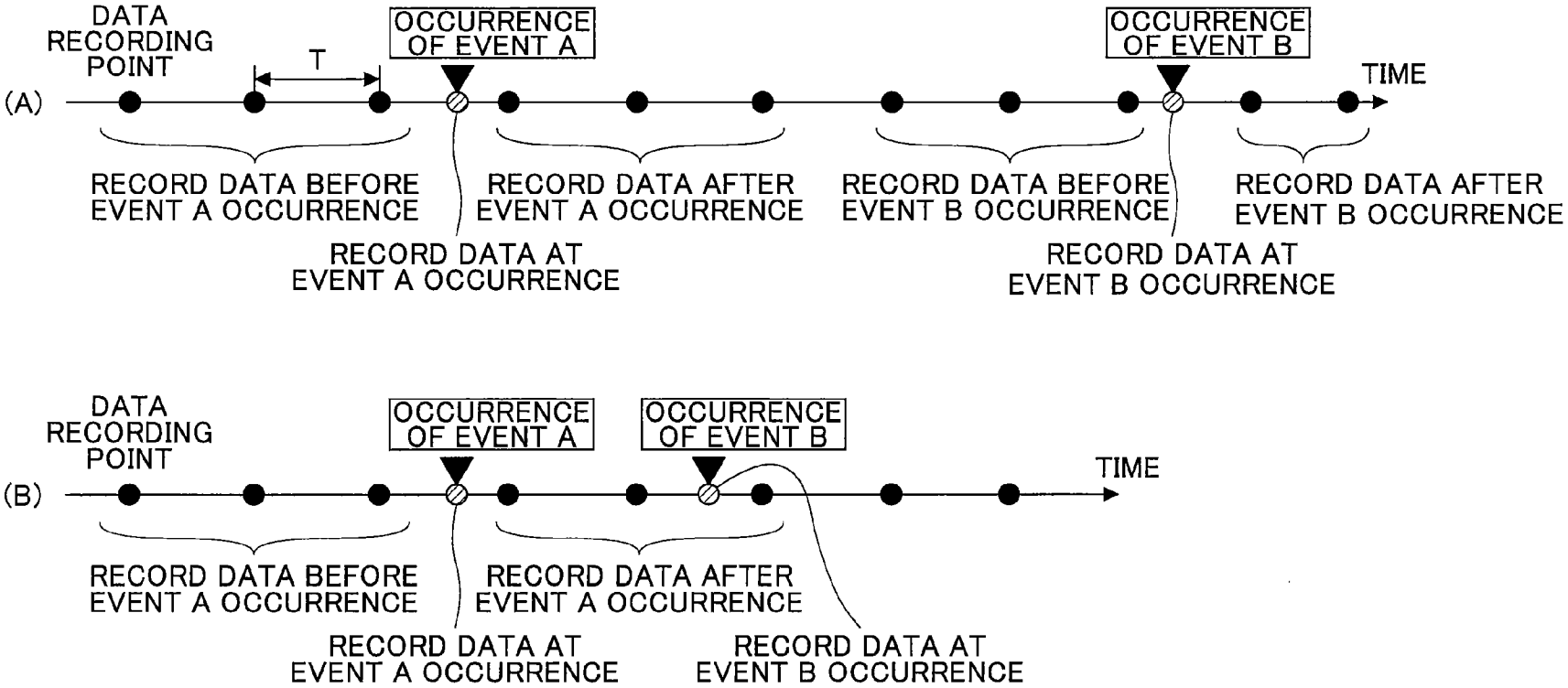
FIG. 3 illustrates data recording operations in the data recording apparatus for a vehicle according to the first embodiment of the present invention.

Next, with reference to FIGS. 2 and 3, operations in the data recording apparatus for a vehicle 10 will be described. FIG. 2 shows a flowchart of one example of a control routine that the microcomputer 12 in the data recording apparatus for a vehicle 10 according to the present embodiment executes. FIG. 3 illustrates data recording operations in the data recording apparatus for a vehicle 10 according to the present embodiment.

In the data recording apparatus for a vehicle 10 according to the present embodiment, the CPU 14 in the microcomputer 12 samples the vehicle states such as various sorts of usage states and/or traveling states based on the signals from the sensors 20 and the ECUs 22 periodically at a predetermined sampling interval s (for example, 50 ms or 500 ms) while the ignition switch of the vehicle is on (step 100). Note that the predetermined sampling interval s may be able to be changed depending on the frequency band for each of the signal of the sensors 20 and/or the ECUs 22.

The CPU 14 temporarily records all the thus sampled data indicating the vehicle states at approximately the same timing in the RAM 16 (step 110). The temporarily recording of the data in the RAM 16 is carried out for every predetermined data recording period T. Note that the predetermined data recording period T (for example, one second, five seconds or the like) can be determined to be greater than or equal to the above-mentioned predetermined sampling interval s. In the RAM 16, all of the data indicating the vehicle states thus sampled for a past predetermined time (for example, 10 seconds, 1 minute, 10 minutes or the like, note that this predetermined time is determined to be greater than or equal to the above-mentioned predetermined sampling interval s and predetermined data recording period T) is temporarily recorded. Thus, in a case where the recording residual capacity becomes zero, the latest sampled data is used to overwrite the data at the position at which the oldest data is recorded (ring buffer).

After having sampled the vehicle states, the CPU 14 determines, based on the thus sampled vehicle states, whether a predetermined event for which data indicating the vehicle states is to be recorded in the nonvolatile memory 18 occurs in the own vehicle (step 120). Note that data to be used as a parameter for thus determining an event occurrence should be at least one item of the data obtained through the current sampling through the sensors 20 and/or the ECUs 22. It is also possible to determine that an event occurs in a case where two or more items of the data satisfy respective requirements. Further, the data to be recorded in the nonvolatile memory 18 includes at least the above-mentioned item of the data used as the determination parameter and may further include another item(s) of data.

For example, as the above-mentioned event, (a) an occurrence of vehicle acceleration greater than or equal to a predetermined value; (b) an occurrence of the opening degree of the accelerator greater than or equal to a predetermined value; (c) both occurrence of the opening degree of the accelerator greater than or equal to a predetermined value and an occurrence of brake oil pressure greater than or equal to a predetermined value (or the brake being engaged) within a predetermined time; (d) both an occurrence of the opening degree of the accelerator greater than or equal to a predetermined value and a predetermined change in the shift position within a predetermined time; (e) a condition concerning a predetermined speed being further added to the above-mentioned condition(s) (a) to (d) in an AND manner; (f) an antilock brake system (ABS) being operated, a traction control system (TRC) being operated and/or a turning behavior control (VSC) being operated; (g) a pre-crash safety system (PCS) being operated (for example, an alarm, a seat belt being wound, an alarm braking system being operated or an intervention braking system being operated); or the like, can be cited.

When having determined in step 120 that the predetermined event occurs in the own vehicle, the CPU 14 determines whether, at the time of the occurrence, data is actually being recorded in the nonvolatile memory 18 based on an event (hereinafter, referred to as a previous event) which occurred before the event (hereinafter, referred to as a current event) determined to occur currently (step 130).

In a case where it is thus determined that data is not actually being recorded based on the previous event, targeted data to be recorded in the nonvolatile memory 18 based on the current event are set (step 140) to be (a) data (hereinafter, referred to as before-event-occurrence data) indicating all the vehicle states within a past predetermined time up until the occurrence of the current event temporarily recorded in the RAM 16 at the time of occurrence of the current event; (b) data (hereinafter, referred to as at-event-occurrence data) indicating the vehicle states sampled during when the current event occurs; and (c) data (hereinafter, referred to as after-event-occurrence data) indicating all the vehicle states that will be sampled until a predetermined time elapses from the occurrence of the current event and temporarily recorded in the RAM 16 every predetermined data recording period T. On the other hand, in a case where it is thus determined that data recording based on the previous event is actually being carried out, targeted data to be recorded in the nonvolatile memory 18 based on the current event are set (step 150) to be only (b) at-event-occurrence data.

When having set the targeted data to be recorded in the nonvolatile memory 18 based on the current event in step 140 or 150, the CPU 14 carries out a process of recording the thus set targeted data in the nonvolatile memory 18 (step 160).

Further, when having determined in step 120 that no predetermined event occurs in the own vehicle, the CPU 14 determines whether, at the time of the determination, data recording in the nonvolatile memory 18 based on an event has not completed yet, i.e., whether the predetermined time to record after-event-occurrence data in the nonvolatile memory 18 from an occurrence of the event has not elapsed yet (step 170).

In a case where a negative determination is thus made, it is determined that data to be recorded in the nonvolatile memory 18 due to an occurrence of an event still remains and the process of step 160 is continuously carried out. On the other hand, in a case where an affirmative determination is made, it is determined that no data to be recorded in the nonvolatile memory 18 remains and the current process is finished.

Thus, in the data recording apparatus for a vehicle 10 according to the present embodiment, in a case where a predetermined event occurs in the vehicle, it is possible to record data indicating the vehicle states before and after the occurrence of the event in the nonvolatile memory 18 that is the permanent recording area. Further, when a predetermined event for which data indicating the vehicle states is to be recorded in the nonvolatile memory 18 occurs in the vehicle, it is possible to change targets of the data to be recorded in the nonvolatile memory 18 based on the current event, based on whether, at the time of the occurrence, recording of data indicating the vehicle states in the nonvolatile memory 18 based on a previous event is actually being carried out.

Specifically, as targeted data to be recorded in the nonvolatile memory 18 based on the current event, before-event-occurrence data, at-event-occurrence data and after-event-occurrence data are set when, at the time of the occurrence of the current event, recording of data indicating the vehicle states in the nonvolatile memory 18 based on a previous event is not actually being carried out. On the other hand, only at-event-occurrence data can be set when, at the time of the occurrence of the current event, recording of data indicating the vehicle states in the nonvolatile memory 18 based on a previous event is actually being carried out.

For example, as shown in FIG. 3 (A), in a case where an event A occurs, thereby recording of before-event-occurrence data, at-event-occurrence data and after-event-occurrence data in the nonvolatile memory 18 based on the occurrence of the event A is carried out, and an event B occurs after the recording is completed, targeted data to be recorded in the nonvolatile memory 18 based on the event B are set to be, as usual, before-event-occurrence data at-event-occurrence data and after-event-occurrence data based on the occurrence of the event B.

On the other hand, as shown in FIG. 3 (B), in a case where an event A occurs, thereby recording of before-event-occurrence data at-event-occurrence data and after-event-occurrence data in the nonvolatile memory 18 based on the occurrence of the event A is carried out, and an event B occurs before the recording is completed, targeted data to be recorded in the nonvolatile memory 18 based on the event B are limited to only be at-event-occurrence data based on the occurrence of the event B.

In this configuration, when a subsequent event occurs after data recording in the nonvolatile memory 18 based on a preceding event is completed, data recording based on the subsequent event is carried out for a usual target scope (before-event-occurrence data at-event-occurrence data and after-event-occurrence data). On the other hand, when a subsequent event occurs before data recording in the nonvolatile memory 18 based on a preceding event has not been completed, data recording based on the subsequent event is carried out for a limited target scope (only at-event-occurrence data) instead of the usual target scope.

Therefore, in the data recording apparatus for a vehicle 10 according to the present embodiment, in a case where a predetermined event occurs plural times successively in the vehicle within a short period of time, data recording in the nonvolatile memory 18 based on the respective event occurrences is not carried out separately, and recording data that indicates the same vehicle states at the same time in the nonvolatile memory 18 in a duplicate manner caused by plural event occurrences is avoided. Therefore, according to the present embodiment, it is possible to prevent the nonvolatile memory 18 from being consumed uselessly when plurality of events occur successively within a short period of time. Thereby, it is possible to carry out data recording in the nonvolatile memory 18 efficiently.

Further, in the data recording apparatus for a vehicle 10 according to the present embodiment, when a predetermined event occurs in the vehicle, at-event-occurrence data indicating the vehicle states at the time of occurrence of the event is recorded in the nonvolatile memory 18. Further, when a subsequent event occurs before data recording in the nonvolatile memory 18 based on a previous event occurrence has been completed, at-event-occurrence data indicating the vehicle states at the time of occurrence of the subsequent event is recorded in the nonvolatile memory 18. Each of before-event-occurrence data and after-event-occurrence data is sampled at the predetermined sampling interval s and is temporarily recorded in the RAM 16 every predetermined data recording period T, and therefore is data indicating the vehicle states for each predetermined data recording period T. In contrast thereto, at-event-occurrence data is data indicating the vehicle states at the time when the event occurs.

Therefore, according to the present embodiment, when a predetermined event occurs in the vehicle, not only before-event-occurrence data for a predetermined period of time before the occurrence of the event and after-event-occurrence data for a predetermined period of time after the occurrence of the event but also at-event-occurrence data indicating the vehicle states at the time of occurrence of the event are recorded in the nonvolatile memory 18 as the permanent recording area. Therefore, it is possible to use the vehicle states at the time of occurrence of the event for subsequent vehicle state analysis.

Note that, according to the above-mentioned first embodiment, the nonvolatile memory 18 corresponds to a "recording means" recited in the claims. Further, an "event occurrence determination means" recited in the claims is implemented as a result of the CPU 14 in the microcomputer 12 executing the process in step 120 in the routine shown in FIG. 2; a "first data recording control means" recited in claim 1 is implemented as a result of the CPU 14 in the microcomputer 12 executing the processes in steps 140 and 160; an "on-data-recording determination means" recited in the claims is implemented as a result of the CPU 14 in the microcomputer 12 executing the process in step 130; a "second data recording control means" recited in claim 1 is implemented as a result of the CPU 14 in the microcomputer 12 executing the processes in steps 150 and 160; and a "data recording control means" recited in claim 2 is implemented as a result of the CPU 14 in the microcomputer 12 executing the processes in steps 140, 150 and 160.

Embodiment 2

Figure 4:
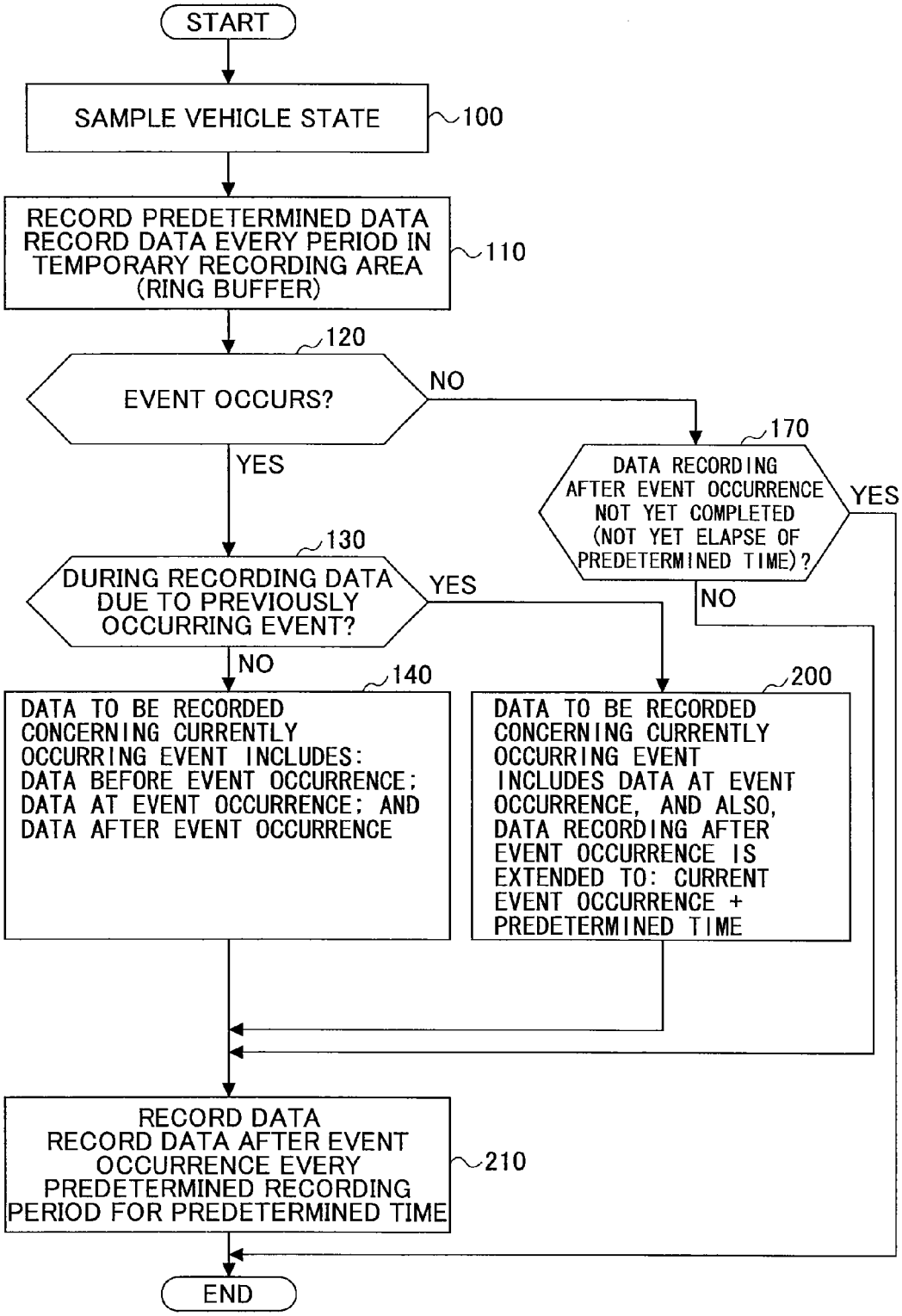
FIG. 4 is a flowchart of a control routine executed in the data recording apparatus for a vehicle according to a second embodiment of the present invention.

A data recording apparatus for a vehicle 10 according to the second embodiment of the present invention is implemented as a result of the CPU 14 in the microcomputer 12 being caused to execute a routine shown in FIG. 4 instead of the routine shown in FIG. 2 in the above-mentioned first embodiment.

Figure 5:
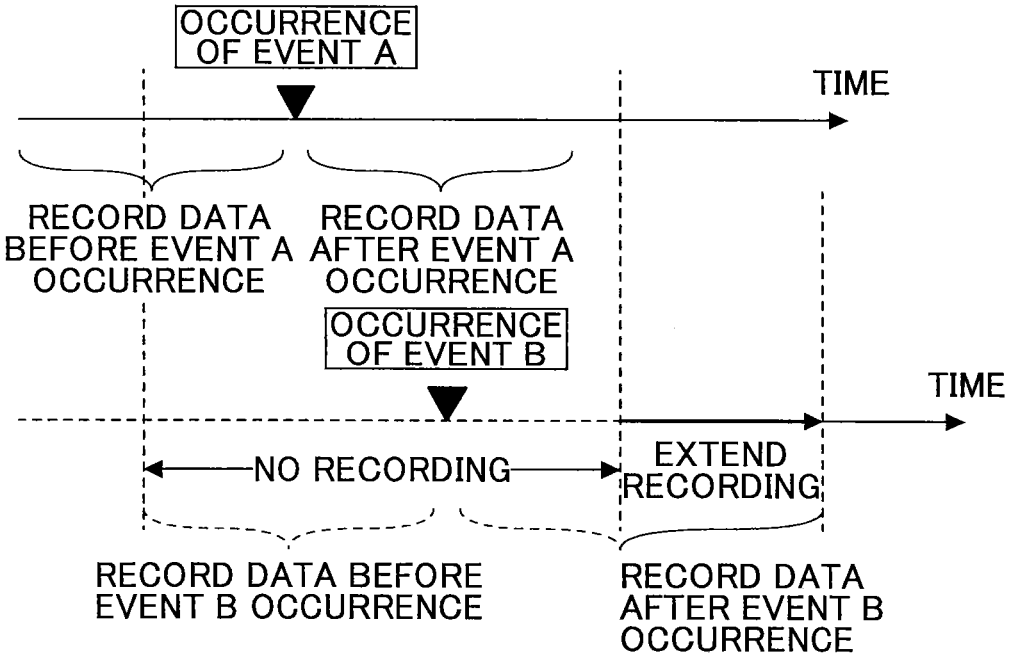
FIG. 5 illustrates data recording operations in the data recording apparatus for a vehicle according to the second embodiment of the present invention.

Below, with reference to FIGS. 4 and 5, operations in the data recording apparatus for a vehicle 10 according to the present embodiment will be described. FIG. 4 shows a flowchart of one example of a control routine executed by the microcomputer 12 in the data recording apparatus for a vehicle 10 according to the present embodiment. Note that, in FIG. 4, the same reference numerals are given to the same steps as those shown in FIG. 2, and the description thereof will be omitted or simplified. Further, FIG. 5 illustrates data recording operations in the data recording apparatus for a vehicle 10 according to the present embodiment.

In the data recording apparatus for a vehicle 10 according to the present embodiment, when having determined in step 130 that data recording based on a previous event is not actually being carried out, the CPU 14 in the microcomputer 12 sets targeted data to be recorded in the nonvolatile memory 18 based on a current event to be before-event-occurrence data at-event-occurrence data and after-event-occurrence data (step 140).

On the other hand, when having determined in step S130 that data recording based on a previous event is actually being carried out, the CPU 14 in the microcomputer 12 sets targeted data to be recorded in the nonvolatile memory 18 based on a current event to be at-event-occurrence data, and also, defers a time of finishing recording of after-event-occurrence data based on the previous event and extends the recording of data indicating the vehicle states (step 200).

Note that when the recording extension is thus carried out, a time of finishing the above-mentioned data recording based on the previous event may be a time when the predetermined time to complete recording of after-event-occurrence data in the nonvolatile memory 18 assuming a case of usual data recording based on the current event has elapsed from the time of occurrence of the current event.

The CPU 14 sets targeted data to be recorded in the nonvolatile memory 18 based on the current event or determines to extend recording in the above-mentioned steps 140 or 200, and then, carries out a process of recording the thus set targeted data in the nonvolatile memory 18, and further, as the case may be, carries out a process of extending the period of time of data recording (step 210).

Thus, in the data recording apparatus for a vehicle 10 according to the present embodiment, when a predetermined event for which data indicating the vehicle states are to be recorded in the nonvolatile memory 18 occurs in the vehicle, it is possible to change targeted data to be recorded in the nonvolatile memory 18 based on the current event depending on whether, at the time of the occurrence, recording of data indicating the vehicle states in the nonvolatile memory 18 based on a previous event is actually being carried out.

Specifically, when, at the time of an occurrence the current event, recording of data indicating the vehicle states in the nonvolatile memory 18 based on a previous event is not actually being carried out, it is possible to set, as targeted data to be recorded in the nonvolatile memory 18 based on the current event, before-event-occurrence data at-event-occurrence data and after-event-occurrence data. On the other hand, when, at the time of the occurrence, recording of data indicating the vehicle states in the nonvolatile memory 18 based on a previous event is actually being carried out, it is possible to set, as targeted data to be recorded in the nonvolatile memory 18 based on the current event, at-event-occurrence data.

Further, in the data recording apparatus for a vehicle 10 according to the present embodiment, when a subsequent event occurs before the data recording in the nonvolatile memory 18 based on a previous event occurrence has been completed, a time of finishing the recording of after-event-occurrence data based on the previous event is deferred, and the recording of data indicating the vehicle states is extended. For example, as shown in FIG. 5, when recording of before-event-occurrence data at-event-occurrence data and after-event-occurrence data in the nonvolatile memory 18 is carried out based on an occurrence of an event A as a result of the event A occurring, and an event B occurs before the recording has been completed, the recording of data indicating the vehicle states in the nonvolatile memory 18 is extended until the predetermined time to complete recording of after-event-occurrence data based on the event B elapses from the occurrence of the event B instead of until the predetermined time to complete the recording of after-event-occurrence data based on the event A elapses from the occurrence of the event A.

In this configuration, when a subsequent event occurs after data recording in the nonvolatile memory 18 based on a preceding event has been completed, data recording based on the subsequent event is carried out for a usual target scope (before-event-occurrence data, at-event-occurrence data and after-event-occurrence data). On the other hand, when a subsequent event occurs before data recording in the nonvolatile memory 18 based on a preceding event has been completed, data recording based on the subsequent event is carried out for a limited target scope (only at-event-occurrence data) instead of the usual target scope, and also, the recording of data indicating the vehicle states in the nonvolatile memory 18 is extended in comparison to only the data recording in the nonvolatile memory 18 based on the previous event occurrence.

Therefore, in the data recording apparatus for a vehicle 10 according to the present embodiment, in case where a predetermined event occurs plural times successively in the vehicle within a short period of time, data recording in the nonvolatile memory 18 based the respective event occurrences is not carried out separately, and recording of data that indicates the same vehicle states at the same time in the nonvolatile memory 18 in a duplicate manner caused by plural event occurrences is avoided. Also, data indicating the vehicle states after the occurrence of the subsequent event is recorded in the nonvolatile memory 18 until an appropriate time.

Therefore, according to the present embodiment, when plural events occur successively within a short period of time, it is possible to prevent the nonvolatile memory 18 from being consumed uselessly while recording data indicating the vehicle states after the occurrence of the subsequent event in the nonvolatile memory 18 necessarily and sufficiently. Thereby, it is possible to efficiently record a necessary and sufficient amount of data in the nonvolatile memory 18.

Further, also in the data recording apparatus for a vehicle 10 according to the present embodiment, when a predetermined event occurs in the vehicle, not only before-event-occurrence data for a predetermined period of time before the occurrence of the event and after-event-occurrence data for a predetermined period of time after the occurrence of the event, but also at-event-occurrence data indicating the vehicle states at the time of occurrence of the event, are recorded in the nonvolatile memory 18 as the permanent recording area. Therefore, it is possible to use the vehicle states at the time of occurrence of the event for a subsequent vehicle state analysis.

Note that, according to the above-mentioned second embodiment, a "data recording control means" recited in claim 3 is implemented as a result of the CPU 14 in the microcomputer 12 executing the processes in steps 140 and 210 in the routine shown in FIG. 4; a "recording extension means" recited in the claims is implemented as a result of the CPU 14 in the microcomputer 12 executing the processes in steps 200 and 210; a "data recording control means" recited in claim 1 is implemented as a result of the CPU 14 in the microcomputer 12 executing the processes in steps 140 and 160 in the routine shown in FIG. 2; and a "data recording control means" recited in claim 4 is implemented as a result of the CPU 14 in the microcomputer 12 executing the processes in steps 140, 200 and 210.

In the above-mentioned second embodiment, when, at the time of occurrence of a current event, recording of data indicating the vehicle states based on a previous event in the nonvolatile memory 18 is actually being carried out, targeted data to be recorded in the nonvolatile memory 18 based on the current event are set to be at-event-occurrence data, and also, a time of finishing recording of after-event-occurrence data based on the previous event is deferred and the recording of data indicating the vehicle states is extended. However, the present invention is not limited thereto. It is also possible to set targeted data to be recorded based on the current event to be at-event-occurrence data and after-event-occurrence data, and also, instead of the above-mentioned extension of recording, defer a time of starting recording of after-event-occurrence data based on the current event while maintaining a time of finishing data recording based on the previous event. In this case, the time of starting data recording based on the current event may be the time of finishing recording of the after-event-occurrence data based on the previous event. Also in this variation, it is possible to obtain the same advantageous effects as those in the above-mentioned configuration of the second embodiment.

Embodiment 3

Figure 6:
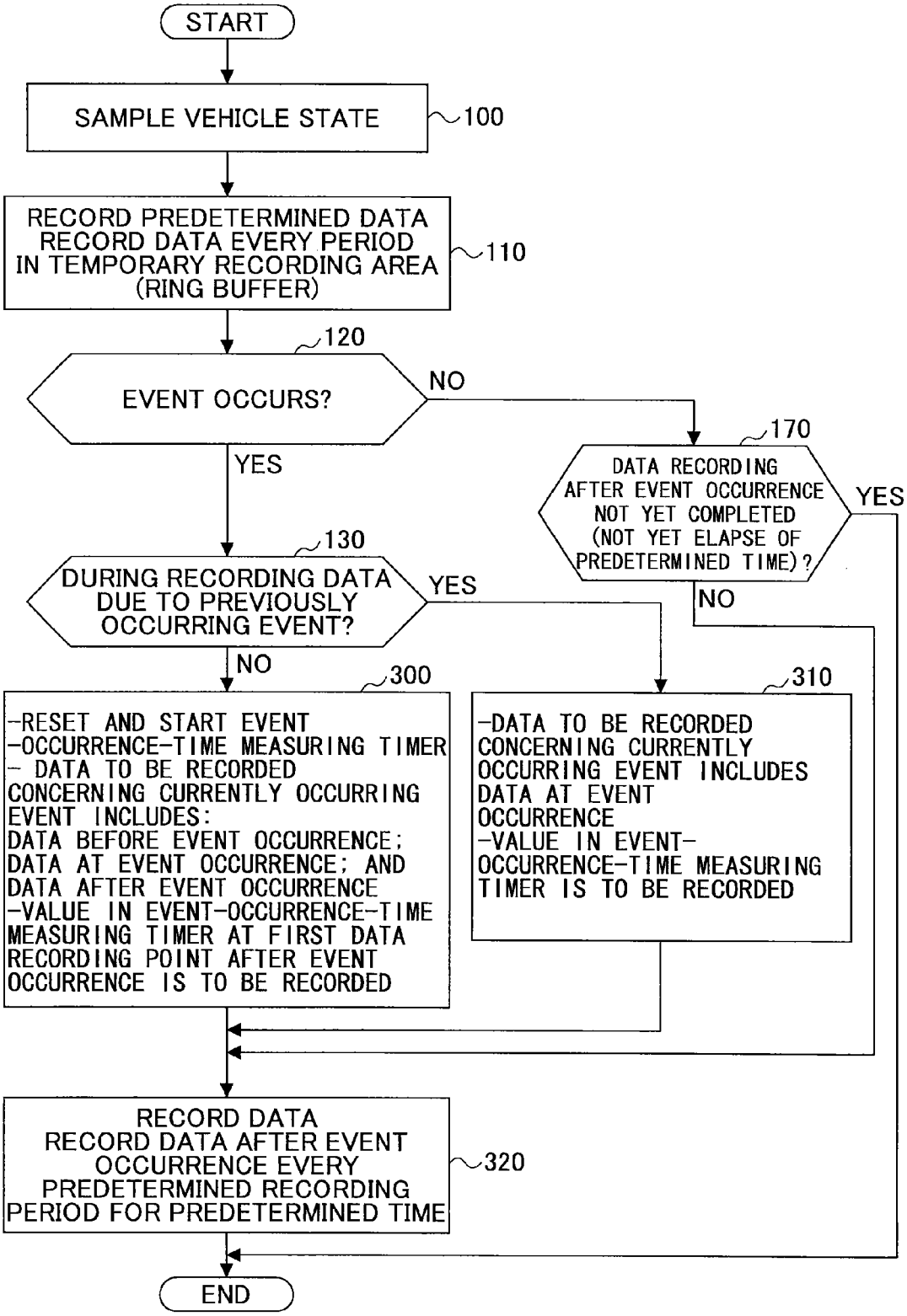
FIG. 6 is a flowchart of a control routine executed in the data recording apparatus for a vehicle according to a third embodiment of the present invention.

A data recording apparatus for a vehicle 10 according to the third embodiment of the present invention is implemented as a result of the CPU 14 in the microcomputer 12 being caused to execute a routine shown in FIG. 6 instead of the routine shown in FIG. 2 or 4 in the above-mentioned first or second embodiment.

Figure 7:
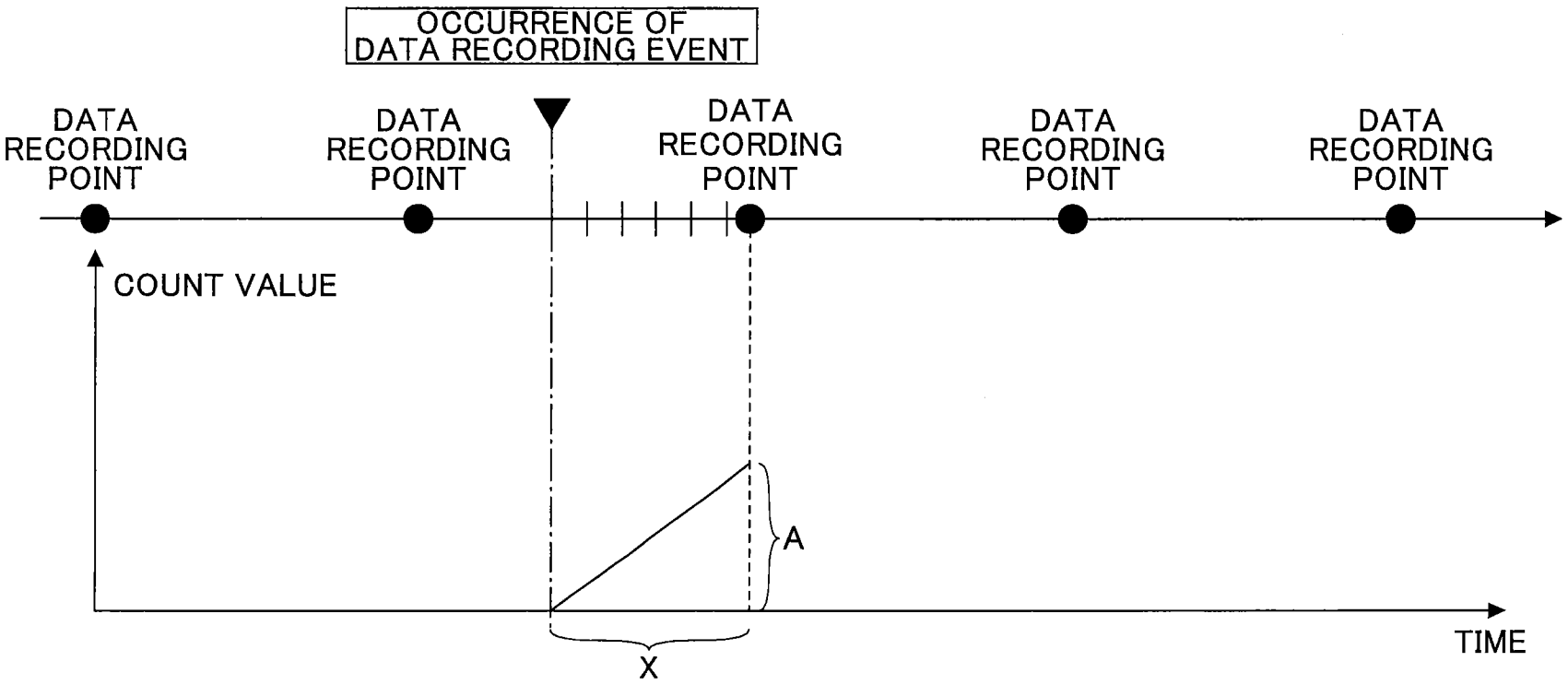
FIG. 7 illustrates data recording operations in the data recording apparatus for a vehicle according to the third embodiment of the present invention.
Figure 8:
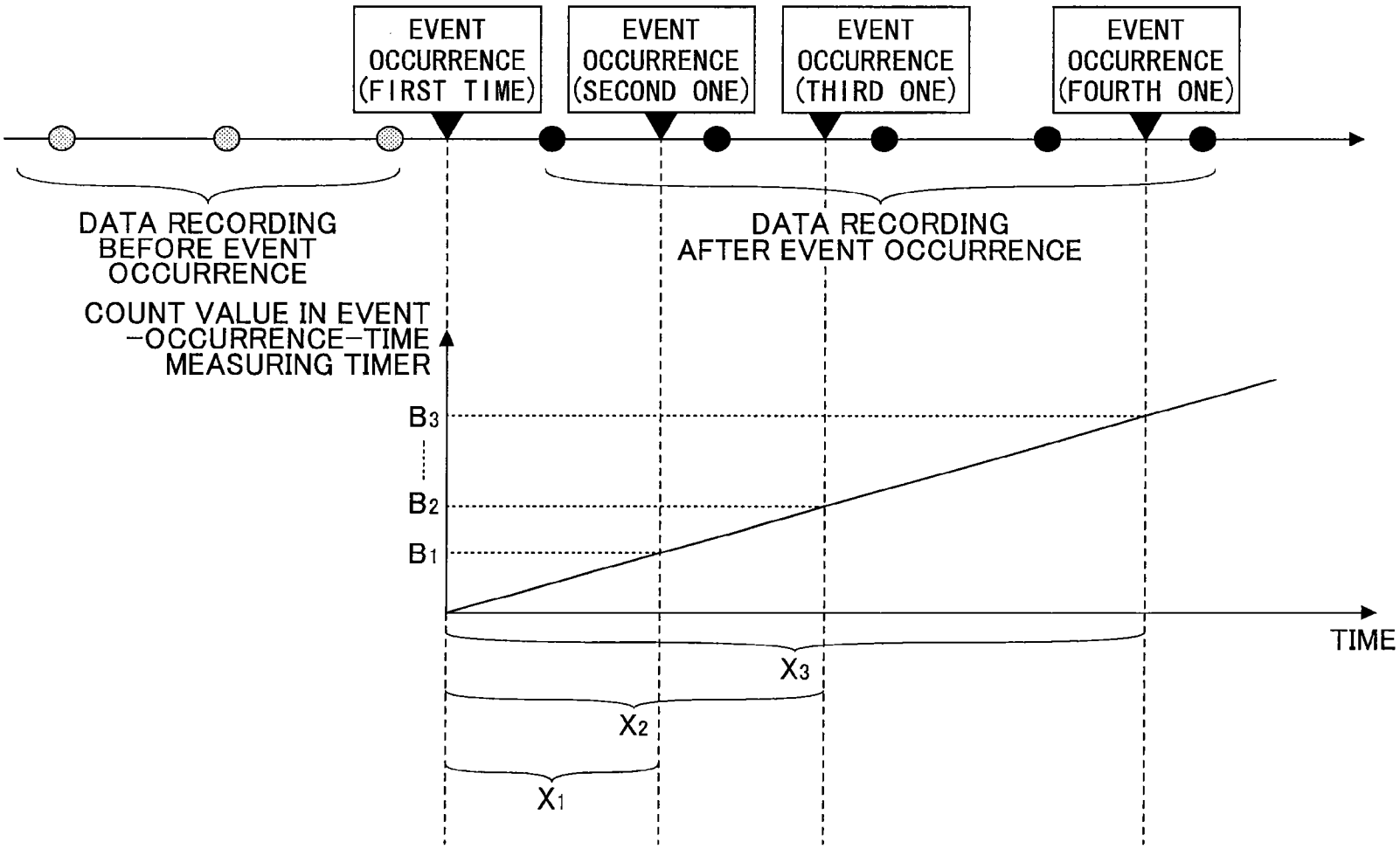
FIG. 8 illustrates data recording operations in the data recording apparatus for a vehicle according to the third embodiment of the present invention.

Below, with reference to FIGS. 6, 7 and 8, operations in the data recording apparatus for a vehicle 10 according to the present embodiment will be described. FIG. 6 shows a flowchart of one example of a control routine executed by the microcomputer 12 in the data recording apparatus for a vehicle 10 according to the present embodiment. Note that, in FIG. 6, the same reference numerals are given to the same steps as those shown in FIG. 2, and the description thereof will be omitted or simplified. Further, FIGS. 7 and 8 illustrate data recording operations in the data recording apparatus for a vehicle 10 according to the present embodiment.

In the data recording apparatus for a vehicle 10 according to the present embodiment, the microcomputer 12 has a timer counter (event-occurrence-time measuring timer) for calculating an event occurrence time in the vehicle different from a timer counter (sampling timer) for counting the predetermined sampling interval s for sampling the vehicle states. Generally, the event-occurrence-time measuring timer is reset and started when a predetermined event occurs during the ignition switch in the vehicle being on, thereafter carries out counting at predetermined time intervals from the time of occurrence of the event and thus is a timer that counts an elapsed time from the event occurrence time. Note that the predetermined time interval for counting up is different from the above-mentioned sampling interval s and is set shorter than the sampling interval s.

The count value in the above-mentioned event-occurrence-time measuring timer is recorded in the nonvolatile memory 18, after the above-mentioned resetting and starting until data recording in the nonvolatile memory 18 based on the event occurrence is completed, at the time of temporary recording in the nonvolatile memory 18 arriving firstly, and at the time of each occurrence of an event that occurs subsequently.

According to the present embodiment, when having determined in the above-mentioned step 130 that no data recording based on a previous event is actually being carried out, the CPU 14 resets and starts the above-mentioned event-occurrence-time measuring timer; also sets, as targeted data to be recorded in the nonvolatile memory 18 based on a current event, before-event-occurrence data at-event-occurrence data and after-event-occurrence data; and further sets, as a target to be recorded in the nonvolatile memory 18, the count value in the event-occurrence-time measuring timer obtained at the time of temporary recording in the RAM 16 arriving firstly until the data recording in the nonvolatile memory 18 base on the occurrence of the current event is completed (step 300).

On the other hand, when having determined in the above-mentioned step 130 that data recording based on a previous event is actually being carried out, the CPU 14 sets, as targeted data to be recorded in the nonvolatile memory 18 based on a current event, at-event-occurrence data; and also, sets, as a target to be recorded in the nonvolatile memory 18, the count value in the event-occurrence-time measuring timer obtained at the time of occurrence of the current event (step 310). Note that the count value in the event-occurrence-time measuring timer to be recorded is recorded in the nonvolatile memory 18 in a manner of being linked with the data recorded in the nonvolatile memory 18 based on the occurrence of the current event.

When having carried out the process of step 300 or 310, the CPU 14 carries out a process of recording the thus set targeted data in the nonvolatile memory 18 (step 320). Note that, in the process of recording after the above-mentioned process in step 310, the count value in the event-occurrence-time measuring timer is recorded in the nonvolatile memory 18 in a manner of being linked with the data recorded in the nonvolatile memory 18 based on the occurrence of the current event.

Thus, in the data recording apparatus for a vehicle 10 according to the present embodiment, in the same way as the above-mentioned first embodiment, when a predetermined event for which data indicating the vehicle states is to be recorded in the nonvolatile memory 18 occurs in the vehicle, it is possible to change targeted data to be recorded in the nonvolatile memory 18 based on the current event depending on whether, at the time of the occurrence, recording of data indicating the vehicle states based on a previous event is actually being carried out. Therefore, it is possible to obtain the same advantageous effects as those in the above-mentioned configuration of the first embodiment.

Further, in the data recording apparatus for a vehicle 10 according to the present embodiment, the count value in the event-occurrence-time measuring timer is recorded in the nonvolatile memory 18. The event-occurrence-time measuring timer is reset and started in a case where, at a time when a predetermined event occurs during the ignition switch in the vehicle being on, recording of data indicating the vehicle states in the nonvolatile memory 18 based on a previous event is not being carried out. And thereafter, the event-occurrence-time measuring timer carries out counting from the time of occurrence of the event at the predetermined time intervals. Then, the count value in the event-occurrence-time measuring timer is recorded in the nonvolatile memory 18 after the above-mentioned resetting and starting until the data recording in the nonvolatile memory 18 based on the event occurrence is completed, at the time of temporary recording in the RAM 16 arriving firstly and at the time of each occurrence of an event that occurs subsequently.

For example, as shown in FIG. 7, when the count value in the event-occurrence-time measuring timer obtained at a time of temporary recording arriving firstly after resetting and starting until data recording in the nonvolatile memory 18 based on an event occurrence is completed is "A", the time x from the event occurrence until the time of temporary recording in the RAM 16 is calculated based on the count value "A"; and the event occurrence time with respect to the time of temporary recording in the RAM 16 by the CPU 14 (i.e., the count value in the sampling timer for counting the predetermined sampling interval s) is determined based on the calculated time x.

Further, as shown in FIG. 8, when the count values in the event-occurrence-time measuring timer obtained at the times of respective occurrences of events that occur subsequently after resetting and starting until the data recording in the nonvolatile memory 18 based on an event occurrence is completed are "B1", "B2" and "B3" in that order, the times x1, x2 and x3 from the event occurrence until the times of temporary recording in the RAM 16 are calculated based on the respective count values "B1" "B2" and "B3"; and the respective event occurrence times with respect to the times of temporary recording in the RAM 16 by the CPU 14 (i.e., the count values in the sampling timer for counting the predetermined sampling interval s) are determined based on the calculated times x1, x2 and x3.

Therefore, in the data recording apparatus for a vehicle 10 according to the present embodiment, it is possible to record, in the nonvolatile memory 18, the count value in the event-occurrence-time measuring timer for counting the elapsed time from an event occurrence time as the time at which the predetermined event occurs in the vehicle. Thereby, it is possible to determine the event occurrence time without depending on the preciseness in the sampling timer for counting the predetermined sampling interval s.

Therefore, in the present embodiment, in order to increase the resolution in the event occurrence time, what is to be carried out is to shorten the count interval in the event-occurrence-time measuring timer and it is not necessary to shorten the data sampling in the sampling timer. Thus, it is possible to prevent a cost increase from occurring due to an increase in the processing load of the CPU 14 for the purpose of increasing the resolution in the event occurrence time.

Note that, in the above-mentioned third embodiment, the above-mentioned sampling timer corresponds to a "first timer" recited in the claims; and the above-mentioned event-occurrence-time measuring timer corresponds to a "second timer" recited in the claims. Further, a "first data recording control means" recited in claims 5-7 is implemented as a result of the CPU 14 in the microcomputer 12 executing the processes in steps 300 and 320 in the routine shown in FIG. 6; and a "second data recording control means" recited in claim 7 is implemented as a result of the CPU 14 in the microcomputer 12 executing the processes in steps 310 and 320. An "occurrence time recording control means" recited in claims 5-7 is implemented as a result of the CPU 14 in the microcomputer 12 recording the above-mentioned count value in the event-occurrence-time measuring timer in the nonvolatile memory 18 as an event occurrence time; and a "timer control means" recited in claims 5-7 is implemented as a result of the CPU 14 in the microcomputer 12 resets and starts the above-mentioned count value in the event-occurrence-time measuring timer in step 300.

Embodiment 4

Figure 9:
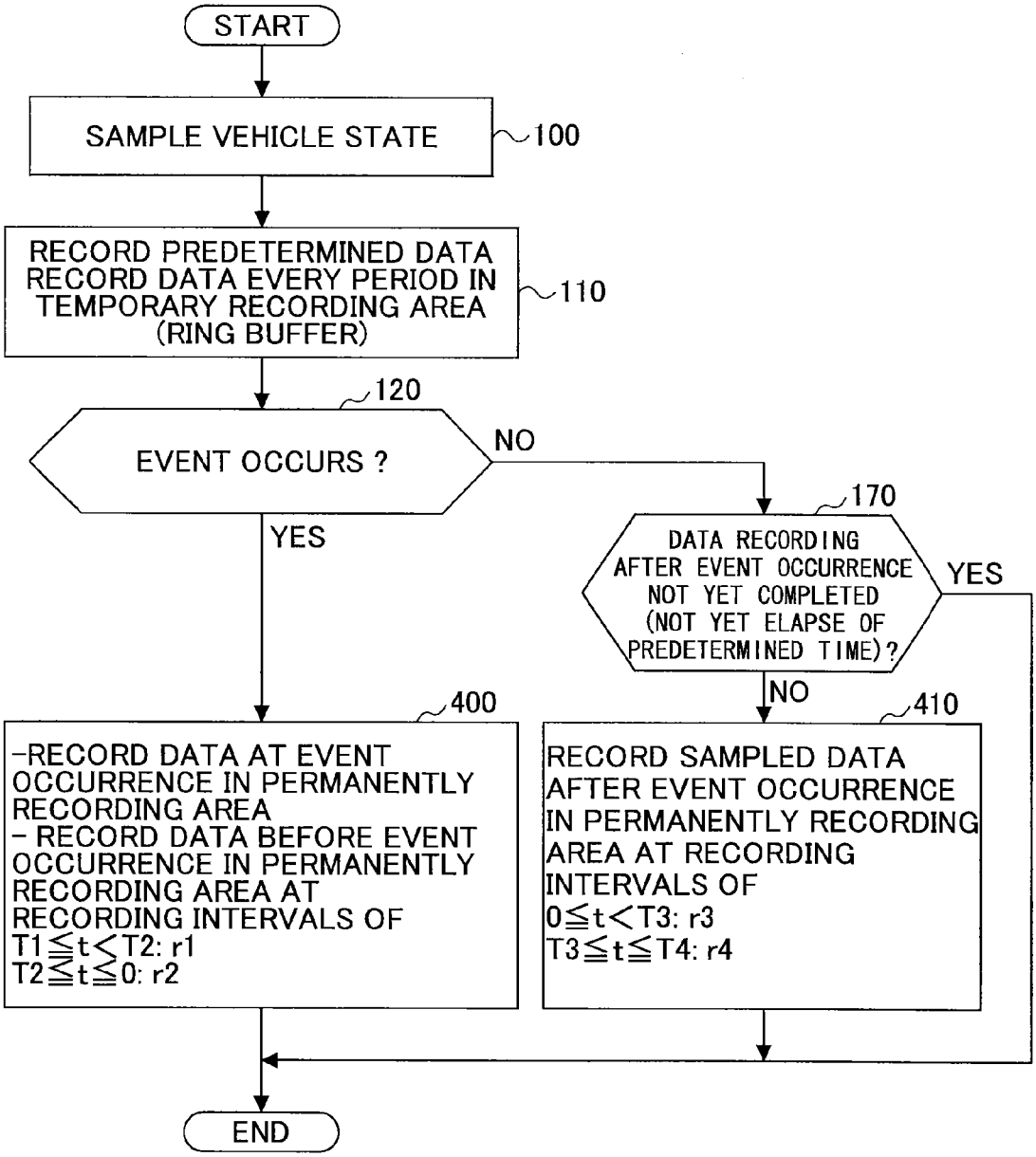
FIG. 9 is a flowchart of a control routine executed in the data recording apparatus for a vehicle according to a fourth embodiment of the present invention.

A data recording apparatus for a vehicle 10 according to the fourth embodiment of the present invention is implemented as a result of the CPU 14 in the microcomputer 12 being caused to execute a routine shown in FIG. 9 instead of the routine shown in FIG. 2, 4 or 6 in the above-mentioned first, second and third embodiments.

Below, with reference to FIGS. 9 and 10, operations in the data recording apparatus for a vehicle 10 according to the present embodiment will be described. FIG. 9 shows a flowchart of one example of a control routine executed by the microcomputer 12 in the data recording apparatus for a vehicle 10 according to the present embodiment. Note that, in FIG. 9, the same reference numerals are given to the same steps as those shown in FIG. 2 and the description thereof will be omitted or simplified. Further, FIG. 10 illustrates data recording operations in the data recording apparatus for a vehicle 10 according to the present embodiment.

In the data recording apparatus for a vehicle 10 according to the present embodiment, when having determined in step 120 that a predetermined event occurs in the own vehicle, the CPU 14 in the microcomputer 12 records at-event-occurrence data indicating the vehicle states sampled when the event occurs in the nonvolatile memory 18, and also, carries out a process of recording the before-event-occurrence data indicating the vehicle states within a past predetermined time until the event occurrence temporarily recorded in the RAM 16 at the time of occurrence of the event in the nonvolatile memory 18 at recording intervals shown below (step 400).

Figure 10:
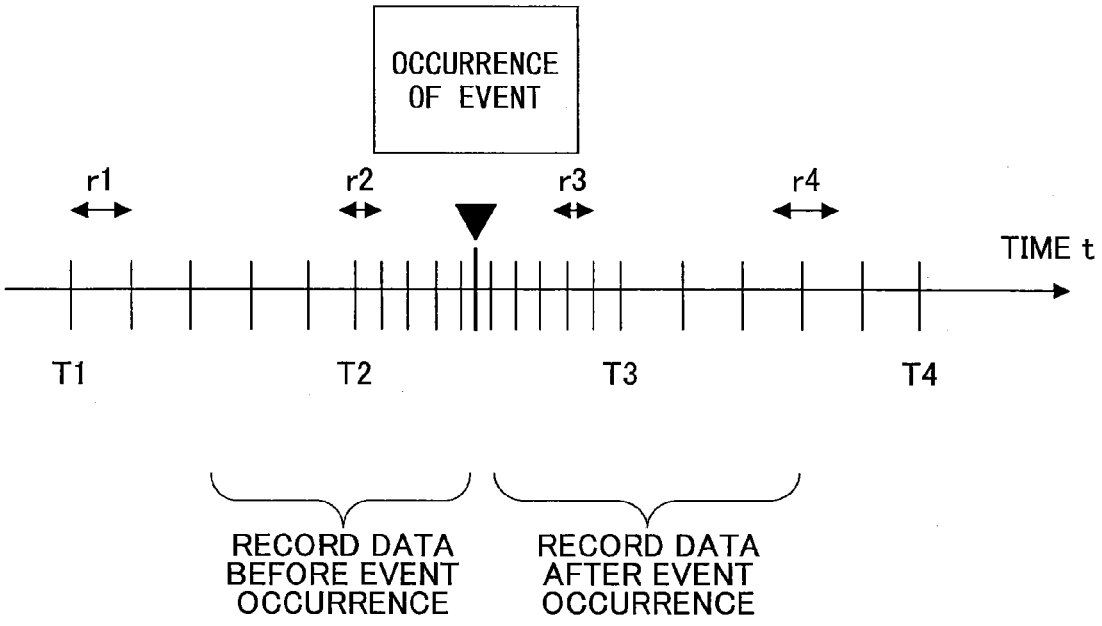
FIG. 10 illustrates data recording operations in the data recording apparatus for a vehicle according to the fourth embodiment of the present invention.

As shown in FIG. 10, as to the data temporarily recorded in the RAM 16 from the past first time T1 until the second time T2 with respect to the event occurrence time from among all the before-event-occurrence data indicating the vehicle states within the past predetermined time until the event occurrence temporarily recorded in the RAM 16, extraction is carried out at first time intervals r1 from all the before-event-occurrence data included therein, and the thus extracted before-event-occurrence data is recorded in the nonvolatile memory 18. On the other hand, as to the data temporarily recorded in the RAM 16 from the past second time T2 with respect to the event occurrence time until the event occurrence time, extraction is carried out at second time intervals r2 from all the before-event-occurrence data included therein, and the thus extracted before-event-occurrence data is recorded in the nonvolatile memory 18.

Note that the first time interval r1 is set to be longer than the predetermined data recording period T at which sampled data is temporarily recorded in the RAM 16. Further, the second time interval r2 is set to be longer than or equal to the predetermined data recording period T, may be the same as the data recording period T and is shorter than the first time interval r1.

Further, in a case of having determined in step 170 that data recording in the nonvolatile memory 18 based on an event has not been completed yet at the time when having determined that no predetermined event occurs in the own vehicle, the CPU 14 carries out a process of recording after-event-occurrence data indicating the vehicle states sampled from the time of occurrence of the event until a predetermined time elapses and temporarily recorded in the RAM 16 every predetermined data recording period T, at recording intervals shown below (step 410).

As shown in FIG. 10, as to the data obtained from the event occurrence time until a third time T3 from among all the after-event-occurrence data indicating the vehicle states sampled from the event occurrence until the predetermined time elapses and temporarily recorded in the RAM 16 every predetermined recording period T, extraction is carried out at a third time intervals r3 from all the after-event-occurrence data included therein, and the thus extracted before-event-occurrence data is recorded in the nonvolatile memory 18. On the other hand, as to the data obtained from the third time T3 until a fourth time T4, extraction is carried out at a fourth time interval r4 from all the after-event-occurrence data included therein, and the thus extracted after-event-occurrence data is recorded in the nonvolatile memory 18.

Note that the third time interval r3 is set to be longer than or equal to the predetermined data recording period T at which sampled data is temporarily recorded in the RAM 16 and may be the same as the data recording period T. Further, the fourth time interval r4 is set to be longer than the predetermined data recording period T and is longer than the third time interval r3. Further, the third time interval r3 may be the same as the above-mentioned second time interval r2, and the fourth time interval r4 may be the same as the above-mentioned first time interval r1. Further, the temporal length of the third time T3 from the event occurrence time may be the same as the second time T2 although they are different in that one is before the event occurrence and the other is after the event occurrence. The temporal length of the fourth time T4 from the event occurrence time may be the same as the first time T1 although they are different in that one is before the event occurrence and the other is after the event occurrence.

Thus, in the data recording apparatus for a vehicle 10 according to the present embodiment, when a predetermined event occurs in the vehicle, it is possible to record data indicating the vehicle states before and after the event occurrence in the nonvolatile memory 18 that is the permanent recording area. Specifically, the closer to the event occurrence time the current time is, the relatively shorter the time intervals r2 and r3 are set to be, and data indicating the vehicle states before and after the event occurrence is recorded in the nonvolatile memory 18 at the shorter time intervals r2 and r3. Further, the farther from the event occurrence time the current time is, the relatively longer the time intervals r1 and r4 are set to be, and data indicating the vehicle states before and after the event occurrence is recorded in the nonvolatile memory 18 at the longer time intervals r1 and r4.

In this configuration, data indicating vehicle states near an event occurrence is finely recorded in the nonvolatile memory 18. On the other hand, the farther from the event occurrence the current time is, the data indicating vehicle states is recorded in the nonvolatile memory 18 more coarsely. Therefore, in the data recording apparatus for a vehicle 10 according to the present embodiment, it is possible to carry out a subsequent vehicle state analysis in detail for a vicinity of an event occurrence while preventing an increase in the consumption amount of the nonvolatile memory 18. Thereby, it is possible to carry out data recording in the nonvolatile memory 18 efficiently.

Note that in the above-mentioned fourth embodiment, as the CPU 14 in the microcomputer 12 executing the processes in steps 400 and 410 in the routine shown in FIG. 9, a "data recording control means" recited in claims 8 and 9 is implemented.

In the above-mentioned fourth embodiment, the time interval for recording data indicating the vehicle states in the nonvolatile memory 18 when a predetermined event occurs in the vehicle is switched in two stages each of before and after the event occurrence. However, the present invention is not limited thereto. It is also possible to switch it in three or more stages or linearly. In this case, the time interval can be determined in such a manner that, the closer to an event occurrence time the current time is, the shorter the time interval is set to be; and the farther from the event occurrence time the current time is, the longer the time interval is set to be.

DESCRIPTION OF REFERENCE NUMERALS

10 data recording apparatus for a vehicle
12 microcomputer
14 CPU
16 RAM
18 nonvolatile memory

The invention claimed is:

1. A data recording apparatus for a vehicle comprising:
circuitry including:

an event occurrence determination circuitry that determines whether a predetermined event occurs in a vehicle;

a data recording control circuitry that, in a case where the event occurrence determination circuitry determines that the predetermined event occurs, records data indicating a vehicle state in a memory at each predetermined time at least until a predetermined period of time elapses from the occurrence of the predetermined event; and an on-data-recording determination circuitry that determines whether the recording based on a previous event is actually being carried out by the data recording control circuitry at a time when it is determined by the event occurrence determination circuitry that the predetermined event occurs, wherein the data recording control circuitry, in a case where the on-data-recording determination circuitry determines that the recording based on the previous event is actually being carried out at the time when it is determined that the predetermined event occurs, carries out recording of only the data at the time in the memory for the predetermined event, and the data recording control circuitry, in a case where the on-data-recording determination circuitry determines that the recording based on the previous event is not actually being carried out at the time when it is determined that the predetermined event occurs, records the data in the memory at each predetermined time at least until the predetermined period of time elapses from the occurrence of the predetermined event, whereas in a case where the on-data-recording determination circuitry determines that the recording based on the previous event is actually being carried out at the time when it is determined that the predetermined event occurs, continues to record the data in the memory at each predetermined time at least until a predetermined period of time elapses from an occurrence of the previous event, and also records the data in the memory at the time when it is determined that the predetermined event occurs.

2. A data recording apparatus for a vehicle comprising:

circuitry including:

an event occurrence determination circuitry that determines whether a predetermined event occurs in a vehicle;

a first data recording control circuitry that, in a case where the event occurrence determination circuitry determines that the predetermined event occurs, records data indicating a vehicle state at each predetermined time in a memory at least until a predetermined period of time elapses from the occurrence of the predetermined event;

an occurrence time recording control circuitry that records in the memory a time when the predetermined event occurs calculated by using a second timer different from a first timer that counts a time required for generating timing for the recording by the first data recording control circuitry;

an on-data-recording determination circuitry that determines whether the recording is actually being carried out by the first data recording control circuitry at a time when it is determined by the event occurrence determination circuitry that the predetermined event occurs; and a timer control circuitry that, in a case where the on-data-recording determination circuitry determines that the recording by the first data recording control circuitry is not being carried out at the time, resets and starts the second timer.

3. The data recording apparatus for a vehicle as claimed in claim 2, wherein the second timer counts an elapsed time from a time when the predetermined event occurs when the recording by the first data recording control circuitry is not being carried out, and the occurrence time recording control circuitry records, in the memory, as a time when the predetermined event occurs, the elapsed time obtained by the second timer at a time of the recording by the first data recording control circuitry arriving firstly after the occurrence of the predetermined event that occurs when the recording by the first data recording control circuitry is not being carried out or a time of a subsequent occurrence of the predetermined event.

4. The data recording apparatus for a vehicle as claimed in claim 2, wherein the circuitry further includes:

a second data recording control circuitry that, in a case where the on-data-recording determination circuitry determines that the recording by the first data recording control circuitry is actually being carried out at the time, carries out the recording of the data at the time in the memory instead of the recording of the data by the first data recording control circuitry based on the occurrence of the predetermined event, wherein in the case where the on-data-recording determination circuitry determines that the recording by the first data recording control circuitry is actually being carried out at the time, the data recorded by the second data recording control circuitry and the time recorded by the occurrence time recording control circuitry are recorded in a manner of being linked with one another.

5. A data recording apparatus for a vehicle comprising:

circuitry including:

an event occurrence determination circuitry that determines whether a predetermined event occurs in a vehicle; and a data recording control circuitry that, in a case where the event occurrence determination circuitry determines that the predetermined event occurs, records data indicating a vehicle state at each predetermined time in a memory at least from a predetermined period of time before the occurrence of the predetermined event until the occurrence of the predetermined event, wherein in the data recording control circuitry, the farther from the time of occurrence of the event a current time is, the longer an interval of the predetermined time is, and the closer to the time of occurrence of the event a current time is, the shorter an interval of the predetermined time is.

6. The data recording apparatus for a vehicle as claimed in claim 3, wherein the circuitry further includes:

a second data recording control circuitry that, in a case where the on-data-recording determination circuitry determines that the recording by the first data recording control circuitry is actually being carried out at the time, carries out the recording of the data at the time in the memory instead of the recording of the data by the first data recording control circuitry based on the occurrence of the predetermined event, wherein in the case where the on-data-recording determination circuitry determines that the recording by the first data recording control circuitry is actually being carried out at the time, the data recorded by the second data recording control circuitry and the time recorded by the occurrence time recording control circuitry are recorded in a manner of being linked with one another.

* * * * *